United States Patent [19]

Conrad

[11] Patent Number: 4,587,797

[45] **Date of Patent: * May 13, 1986**

[54] BRIDOON BIT

[76] Inventor: Ulrich Conrad, Hans-Am-Ende-Weg 23, 2862 Worpswede, Fed. Rep. of Germany

[ * ] Notice: The portion of the term of this patent subsequent to Mar. 1, 2000 has been disclaimed.

[21] Appl. No.: 466,570

[22] Filed: Feb. 15, 1983

[30] Foreign Application Priority Data

Apr. 18, 1979 [DE] Fed. Rep. of Germany ..... 2915573

[51] Int. Cl.[4] ..... B68B 1/06

[52] U.S. Cl. ..... 54/8

[58] Field of Search ..... 54/7, 8, 9

[56] References Cited

U.S. PATENT DOCUMENTS

| | | | |
|---|---|---|---|
| 360,296 | 3/1887 | Heinze | 54/8 |
| 466,485 | 1/1892 | Brockington | 54/8 |
| 472,145 | 4/1892 | Squier | 54/8 |
| 1,678,532 | 7/1928 | Preece | 54/7 X |
| 2,512,244 | 6/1950 | DeWolfe | 54/8 |
| 2,810,250 | 10/1957 | Smith | 54/7 |

*Primary Examiner*—Robert P. Swiatek

*Attorney, Agent, or Firm*—Trexler, Bushnell & Wolters, Ltd.

[57] ABSTRACT

A bridoon bit with curb arms is provided with a thickened center portion having a curved lateral axis, and with end portions outwardly thereof having an opposite curvature in order that the bit may best conform to the anatomy of a horse's mouth, avoiding pressure points and preventing the horse's mouth from becoming insensitive.

2 Claims, 36 Drawing Figures

BRIDOON BIT

RELATED APPLICATION

This application comprises an improvement upon my co-pending application Ser. No. 140,851, filed Apr. 16, 1980 for BRIDOON BIT, now U.S. Pat. No. 4,375,147.

DESCRIPTION

The invention has to do with a bent bridoon bit which has on both opposite ends one eyelet each for holding a bridoon ring.

From the use as well as from pertinent horse books there have been known bar bits and divided bits, among the latter especially the widely known co-called water bits. On the one hand, a bit must lie in the mouth without causing pain to the horse and must transfer the movement of the reins to the tongue or the jaw of the horse as clearly as desired each time while being gentle to the mouth. On the one hand, there are bits, such as the continuous rubber bit, which, just due to the material, are very soft for the mouth but have the disadvantage of an insufficient transfer of the command to the horse. On the other hand, there exists a curved bar which has a very sharp effect for the horse and whose sharpness gradually destroys the sensitivity of the mouth as well as the guidability of the horse.

The invention is therefore based on the problem of developing by a better adjustment to the anatomy of the mouth a bridoon by means of which the horse can be guided more sensitively and by means of which the sensitivity of the horse is maintained as long as possible.

For this purpose the bridoon as defined in the invention is designed as a bar having soft edges which is thickened in the center and at the ends and whose center part can be rigid or, however, also movable. By the thickening in the center, the bit adjusts to the center cleft of the tongue and encloses the tongue also partly laterally in a widened semi-circle which then ends again at both sides before the passage through the mouth cleft of the lip in a slight counter movement in form of a slight curvature of the right side and of the left side. By the special shape, a sliding of the bridoon through the mouth cleft is prevented and a slight guiding to the right or to the left is guaranteed—with simultaneous gentle treatment of the opposite lip of the horse during a predominantly one-sided pull on the reins.

The horse feels this predominantly one-sided pull on the reins immediately in its mouth and not only after the sliding through of the bit on the opposte lip. Thus it can react more sensitively. Testing with the bridoon bits as defined in the invention confirms that.

For the rigid types of the bridoon bit as defined in the invention, the possibility of a turning of the bit in connection with a stronger pull on the reins was taken into consideration in such a way that, with a slight tightening of the reins the horse finds an especially soft bit form at the tongue on which the horse can pleasantly lean in order to guarantee the necessary connection between the mouth of the horse and the hand of the rider. With increasing leaning, i.e. with a stronger counter-pressure of the horse against the rider's hand, the more considerably curved side of the elliptical center cross section of the bit bears, in place of the broad side, more and more against the tongue because of the slight turning movement of the bit. This forces the horse to respect the restraining help of the reins by slowing down the speed and demands less force of the rider. On the one hand, the horse's mouth stays soft longer and it is thus more sensitive in its reactions to the assistance of the reins and, on the other hand, the horse can be dominated more easily by the rider in dangerous situations.

For a horse which is difficult to rein in its forward urge because its mouth is hard inside or because of temperamental faults or for other reasons, the center crosspiece, which is bent forward, is bridged as defined in a further development of the invention. Here the crosspieces can also be thickened in the center, and the center of the crosspiece can then be located expediently in the connection line of the two eyelets for the bridoon rings.

For special purposes there is recommended to design the thickened center portion of the bar as a roll which has an expediently eccentric contour and is turnable around an axis located transverse to the axes of the eyelets.

The invention allows additional especially advantageous developments which are partly the object of the sub-claims and are explained in the following by means of the embodiments of the invention illustrated in the attached drawings. In the following description, "top" means the zone adjacent to the horse's ears, "below" means the zone of the end of the mouth, "front" means the zone of the bridge of the nose and "back" means the zone of the lower jaw.

FIG. 26 shows a schematic back view onto the upper jaw with the mouth open with the bit, according to FIG. 24, set in;

Figure 1:
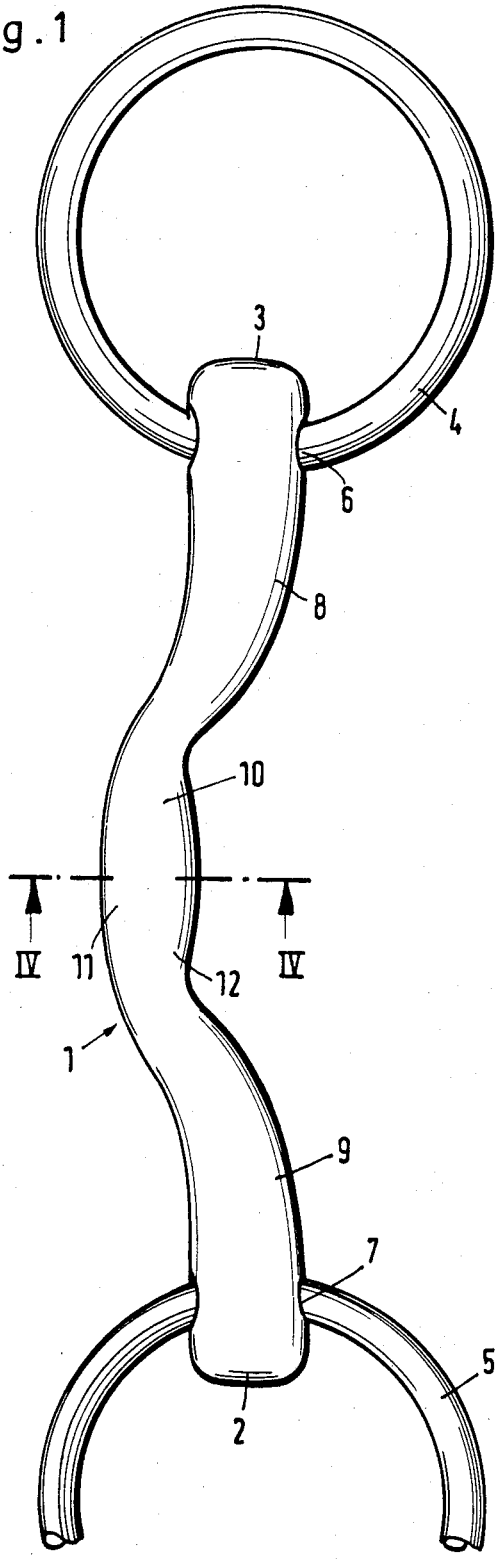
FIG. 1 shows a top view of a bit equipped with the characteristics of the invention.

The bit 1 illustrated in FIG. 1 has the form of a hollow or solid bar of refined steel or Argentan essentially closed on both ends. On each of its ends 2, 3, the bit is provided with an eyelet 6, 7. Through each eyelet 6, 7 there is led a bridoon ring 4, 5 which is only partly illustrated.

Figure 2:
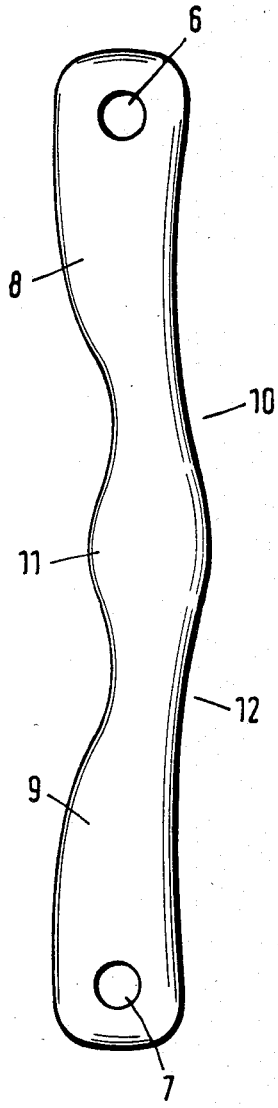
FIG. 2 shows a view of the bit according to FIG. 1 from the back.
Figure 3:
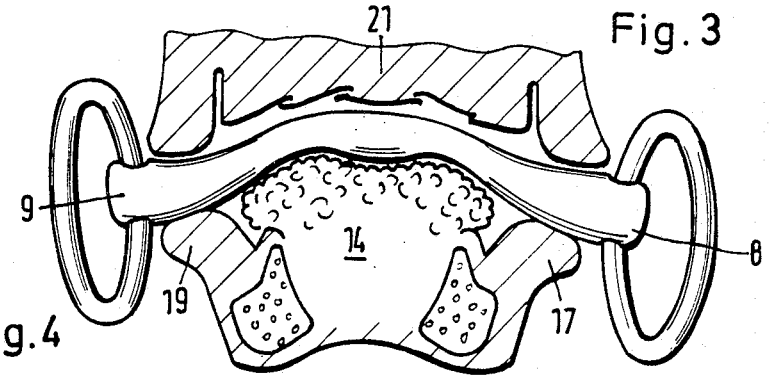
FIG. 3 shows a top view of the inserted bit of FIG. 1.

The bar 1 as a whole is bent forward thus in the direction of that plane which is set by the two axes extending through the two eyelets 6, 7. In detail, from each eyelet 6, 7 there extends a somewhat curved first zone 8 or second zone 9 to a center portion 10 which connects the two zones and which is curved in a direction opposite to the palate. As shown, the diameter of the first zone 8 and of the second zone 9 narrows starting from the respective eyelet 6, 7 toward the center. Compared to that, the center portion is formed into a thickening 11 (FIG. 2) which has an oval or round cross section and is stretched olive-like or plank-like.

This form of bit has no sharp edges on its periphery, it is smooth throughout and, with the reins loose, leaves enough play. By means of the center thickening 11, the bit—by the adjustment to the upper contour of the tongue—remains localized to the tongue because the thickening 11 places itself into the center groove of the tongue. Thereby the horse can be turned around very easily by means of the shifting of the bit by the horse because lateral shifting of the bit is immediately noticed by the horse because of the shifting of the thickening. With a strong pull on the reins, the back side of the thickening 11 presses on the tongue, thus it forwards the command to the horse without the bit cutting in deeply.

Figure 4:
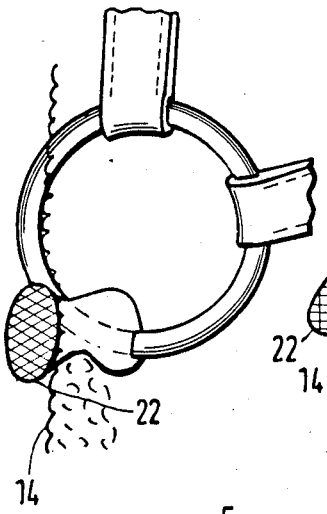
FIG. 4 shows a cross section through the center IV—IV of the bar bit, as defined in the invention, according to FIG. 1.
Figure 5:
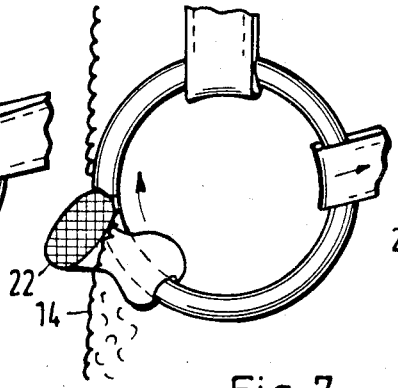
FIG. 5 shows a cross section, according to FIG. 4, of the bit shifted after a slight pull on the reins.

The bar bit illustrated in FIGS. 1–6 excels by the fact the center part of the triple-curved bar points even without pull on the reins toward the palate 21 and is bent around the tongue 14 in such a way that the side ends of the bridoon bit must have a slight counter-curve at 8, 9 before they lead into the zone of the lips 17, 19. With a pull on the rein, for instance at the lip 17, the center part bent around the tongue 14 essentially holds the bit in the center of the mouth so that the opposite lip, thus lip 19, is treated more gently and thus makes sliding of the bit through the mouth cleft difficult. The illustration in FIG. 4 shows the position of the rigid bit according to FIGS. 1, 2 and 3 without pull on the reins. Here the center part of the bit, which in the cross section 22 has the shape of an ellipse, lies parallel to the front surface of the tongue.

Figure 6:
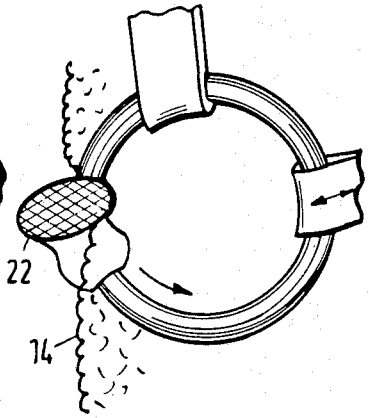
FIG. 6 shows a cross section, according to FIG. 4, of the bit shifted after a strong pull on the reins.

The illustration in FIG. 6 shows the further turning of the bit—recognizable by means of the cross section 22 produced by stronger pull on the rein, said turning is brought about by the fact that the bit slides up somewhat on the bridoon rings 4, 5. The bridoon bit returns to the starting position corresponding to FIG. 4 when the pressure of the reins diminishes and the bit slides downward into the bridoon ring by gravity and also by the tension of the lips.

The bit illustrated in FIGS. 7–11 excels by the fact that between the bridoon rings 4, 5 it consists firstly of a thick and therefor soft bar 1 which is bent downward thus toward the palate of the horse and that, secondly, farther above approximately between the eyelets 6, 7 of the bridoon rings 4, 5 it has a thinner crosspiece 13 which is bent even farther toward the front—thus toward the palate. The lower curve (bar 1) is strengthened in the center toward the tongue 14 (at 11) and is widened there like a plum pit. Said strengthening 11 is solid and forms the main weight of the bit. Because of the point of gravity being shifted downward, only this soft center portion 10 of the bit touches the tongue 14 in case of a lighter pull on the rein 15. The upper thinner crosspiece 13 is effective only in case of a stronger pull of the rein 15 to the tongue 14, namely last but not least by a forward shifting of the bridoon heads in the bridoon rings 4, 5 (FIG. 11) toward the front above.

One can take into consideration the different temperaments of the horses as well as the different hardness and insensitivity of the tongue by producing the bit, as defined in the invention, with different degrees of hardness or sharpness, especially with respect to the sharpness of the crosspiece 13.

Figure 7:
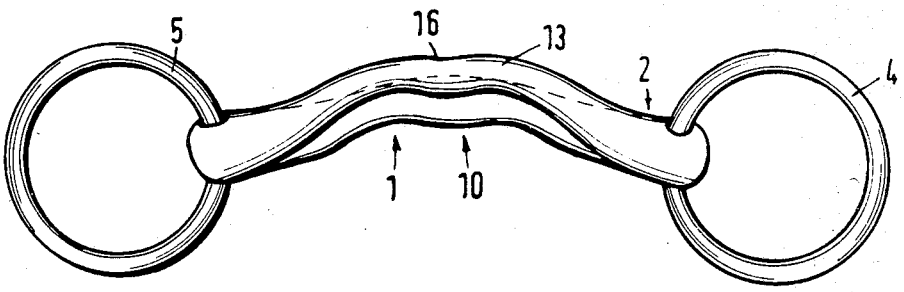
FIG. 7 shows a perspective top view of another embodiment of the invention.
Figure 8:
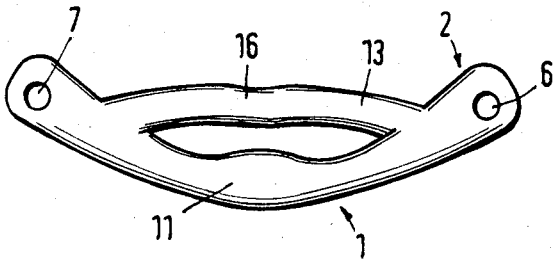
FIG. 8 shows a view of the bit, according to FIG. 7, from the back.
Figure 9:
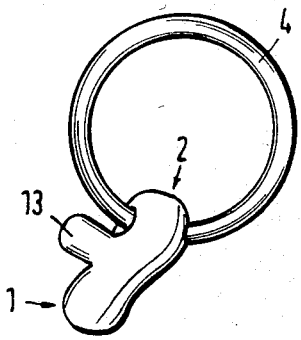
FIG. 9 shows a lateral view of the bit according to FIG. 7.

Thus the bit according to FIGS. 7, 8 and 9 can be made also in such a way that it enables the horse to choose between soft leaning on the lower thick bar 1 or on the more unpleasant rein guiding at the upper sharper crosspiece 13. Since, as a rule, the horse decides in favor for the more pleasant thing, hunts can be ridden more easily and the horse can be better controlled without the necessity of putting in a sharper bit from the start. The emphasizing of the bar center 10 toward the tongue side makes it easier for the horse to react in time to lateral pull on the reins and thus prevents the pulling through toward one side with simultaneous stress on the opposite lip.

Figure 10:
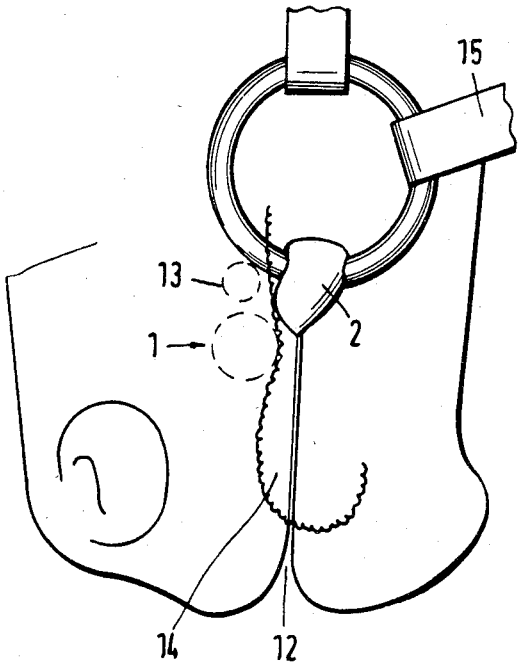
FIGS. 10, 11 show a schematic illustration for the explanation of the mode of operation of the bit according to FIG. 7.
Figure 11:
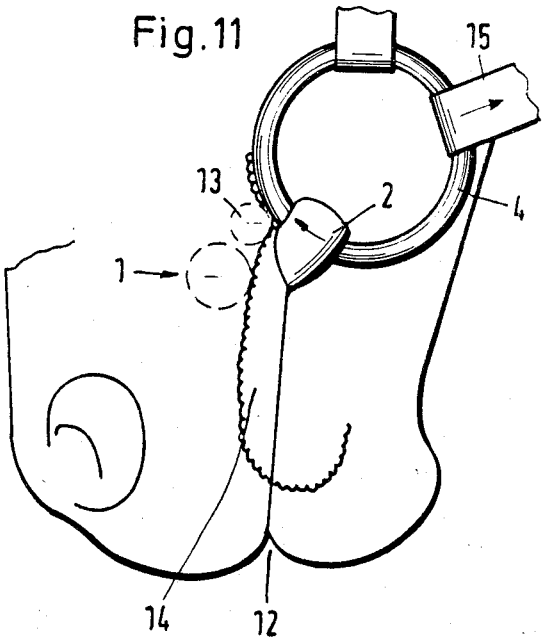

FIG. 10 shows as a broken line the position of the bit, as defined in the invention, on the tongue 14 in the mouth of the horse without pull on the rein 15. One sees that the horse leans against the soft center 10 of the bar. When the rein 15 is pulled, one recognizes from FIG. 11 that the crosspiece 13, which is sharper toward the back, puts pressure on the tongue 14 of the horse. Thereby the horse receives an easily perceivable command.

This bit is especially suited for the temporary correction of horses, which push the reins out of the rider's hand, and is immediately understood by the horse. However, it requires a gentle hand of the rider and wise-self-restriction to that which is absolutely necessary. When the upper thin bar moves farther in the direction of the palate, the contrast effect is weakened. Thus it can also be used for so-called "pullers" (horses that put too much weight into the rider's hand).

Figure 12:
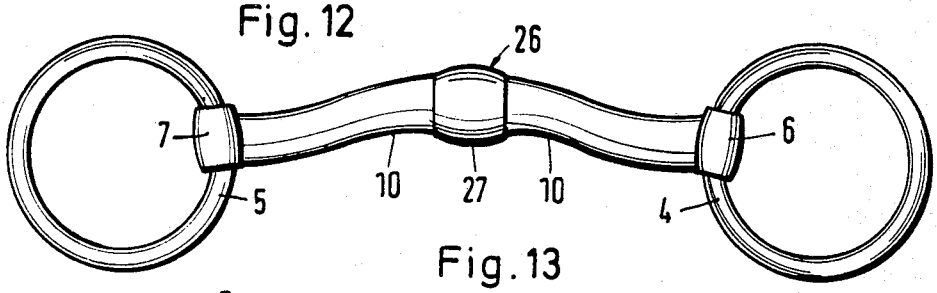
FIG. 12 shows a top view of another type example of a bit as defined in the invention.
Figure 13:
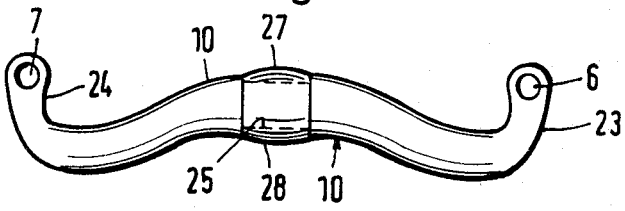
FIG. 13 shows a front view of the bit from FIG. 12.

The bit as defined in the invention and shown in FIGS. 12–16 is especially suited to induce horses, whose mouth has been dulled inside—which are thus "dead" in the mouth—to play with the bit and to promote a slight desirable chewing activity. According to the invention, the bit excels by the fact that the eyelets 6, 7 are attached on short arms 23, 24 bent upward at an angle. Said arms 23, 24 are located transverse to the axis of the center bar 10 of the bit which is curved forward (FIGS. 12, 14) and upward (FIG. 13). By means of the bridoon rings 4, 5, the bit hangs on the lateral arms 23, 24 in the upper closure of the mouth cleft 21 which holds the bit elastically downward.

Figure 15:
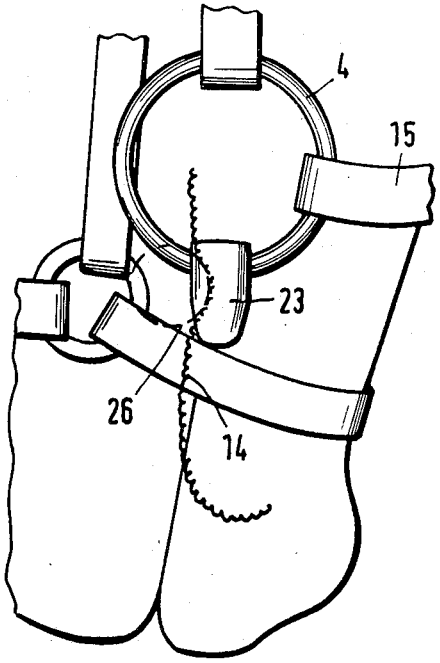
FIGS. 15, 16 show a schematic illustration for the explanation of the mode of operation of the bit from FIG. 12.
Figure 16:
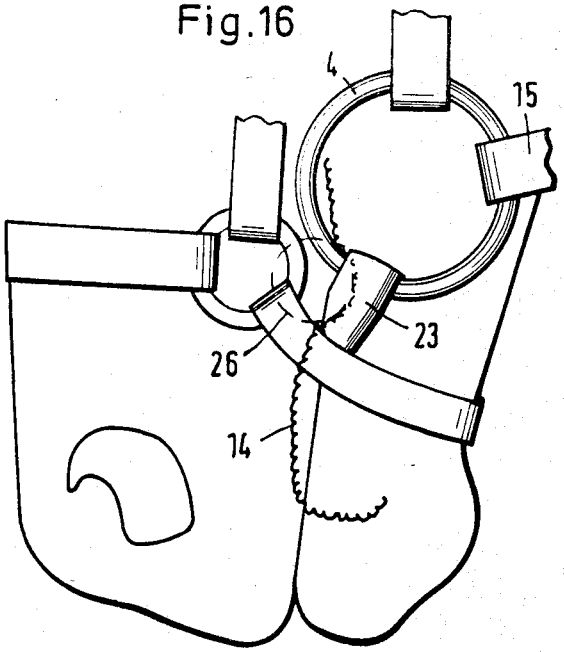
Figure 17:
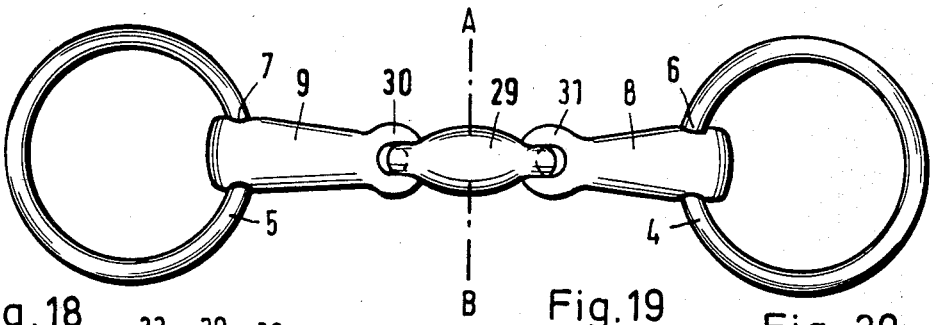
FIG. 17 shows a view from the back onto type example of a bit as defined in the invention.
Figure 18:
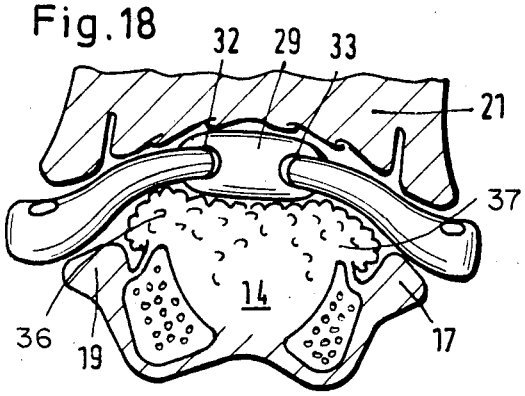
FIG. 18 shows a top view of the bit according to FIG. 17.

If the rein 15 (FIGS. 15, 16) is pulled, the bar 1, which is bent several times and lies horizontally in the mouth, makes a turn against the tongue 14—namely from the position indicated by a broken line in FIG. 15 into the position indicated in FIG. 16.

Figure 14:
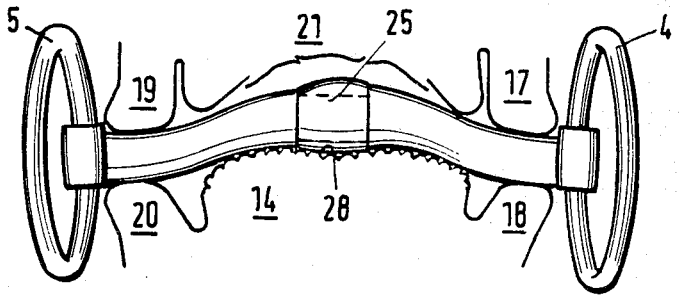
FIG. 14 shows a top view of the bit from FIG. 12 with a cross section of the mouth.

As it is also shown especially in FIGS. 12–14, there is used in the center of the bar 1 a padded ring 26 which is rotatable over a thinner axis 25 and has in its periphery a one-sided strengthening enlargement 27 and on the other side a flattening 28. Thereby an eccentric unbalance originates which is terminated smoothly at the transistion zones to the center portion 10 of the bar 1. The transitions are soft and go over smoothly with respect to their form. By playing with its tongue, the horse can turn the short thickened padded ring 26 and the flat side or the curved side can alternatingly play toward the tongue if the surface of the padded ring has a suitable grip.

The embodiment of the invention shown in FIGS. 17–20 is a bit divided twice where the first zone 8 and the separate second zone 9 are flexibly connected by a softly made center piece 29. The shortened first zone 8 is formed as an eye 31 toward the center and the shortened second zone 9 is provided with a second eye 30 toward the center. The first eye 31 and the second eye 30 extend each through an eyelet 32, 33 on the lateral end of the center piece 29. Thereby the center piece 29 is relatively freely movable with the tongue play of the horse. Nevertheless, this bit does not pinch the tongue either on the right or on the left since the first and the second zone 8, 9 are kept apart from each other by the center piece 29, which is about 4 cm. long, so that an acute angle cannot originate in the center. This type stimulates the chewing of the horse's mouth valued so highly by the rider.

Figure 19:
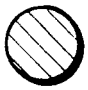
FIG. 19 shows the view along a cut A–B from FIG. 17.
Figure 29:
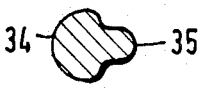
FIG. 29 shows the view of a cut A–B through the bit according to FIG. 20.
Figure 20:
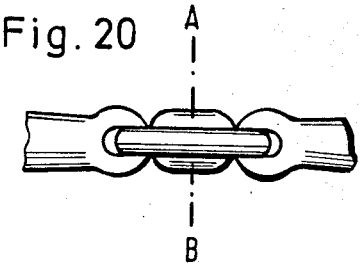
FIG. 20 shows a front view of a center part of a variation of the bit from FIG. 17.

The center piece 29, for which expedient forms of the cross section can be recognized from FIGS. 19 and 29, are made very soft at the back side 34 of the tongue and are possibly made softer at the narrower front side 35. Naturally, the bit can also be buckled on in order to make a rough horse controllable.

With a strong pull on the reins, the pressure acts always on the center of the tongue 14 which can be pressed together only at the lateral edges 36, 37. The pinching of the tongue nerves, that is otherwise feared so much, and the bleeding of the tongue can no longer occur with this bit as defined in the invention. This embodiment of the invention is therefore without problems for the rider and the horse alike. The soft side is therefore recommended better than the singly divided water snaffle for young horses being trained to ride or jump. The sharper front side of the center piece 35, too, has a more pleasant effect on the tongue of the horse than the singly divided bit. Therefore this type example of the bit as defined in the invention is recommended especially for horses that are ridden by riding students who, as a rule, do not yet have a hand independent of the sitting motions.

Figure 21:
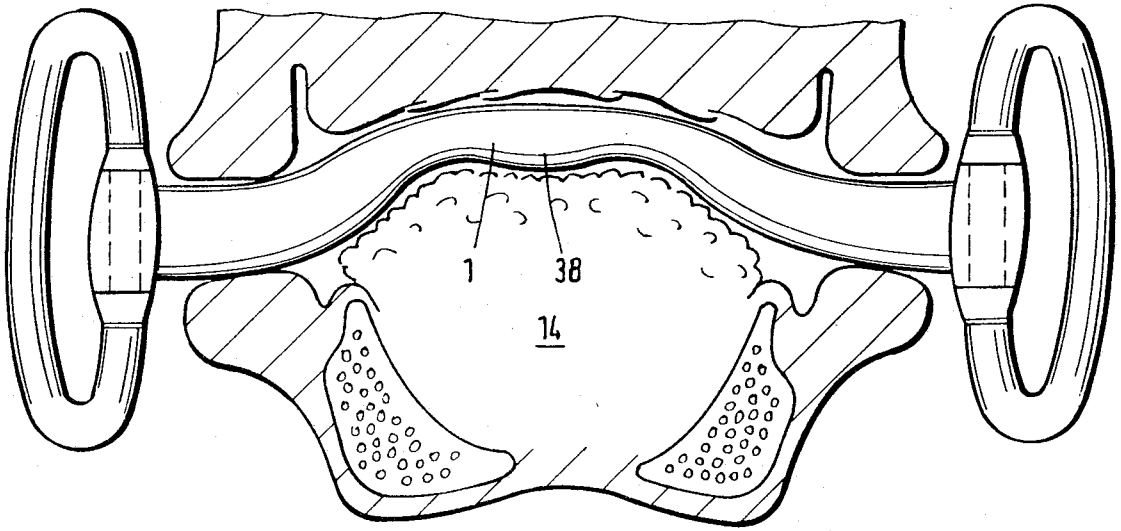
FIG. 21 shows a top view of another type example of a bit, as defined in the invention, as a transition bridoon for bridle bit curbing.
Figure 22:
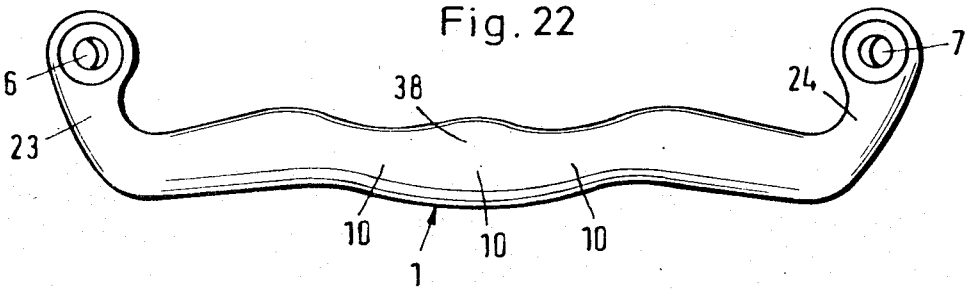
FIG. 22 shows a back view onto the bit according to FIG. 21.
Figure 23:
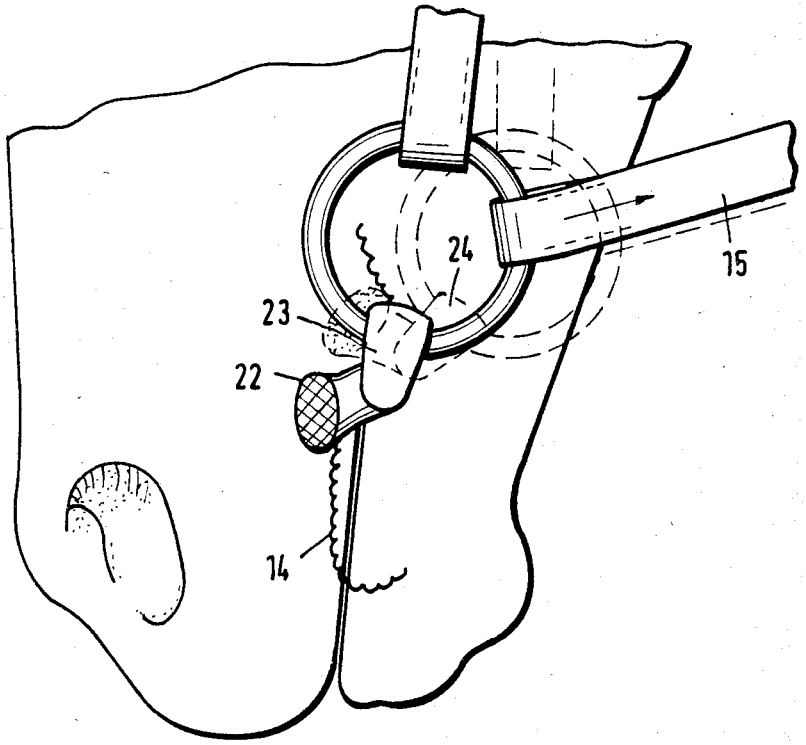
FIG. 23 shows a schematic illustration of the mode of operation of the bit according to FIG. 21.

The embodiment of the invention illustrated in FIGS. 21–23 shows a bit especially intended for young horses in the first training stage which still have difficulties keeping their head still because the neck muscles are not sufficiently developed, wherefore these horses still have difficulties leaning steadily on the bit. As it is illustrated, the bar 1 is bent slightly downward (FIG. 22) and considerably more toward the palate side (FIG. 21) and has on the right end and on the left end short arms 23, 24 turned downward on whose ends the eyelets 6, 7 are provided. As illustrated especially in FIG. 23, with only a gentle pull on the rein 15 (for example, a pull of about 1 to 2 cm.) pressure is hardly exerted on the tongue 14. This is due first to the shape and orientation of the center portion 10 of the bar 1 relative to the arms 23, 24. The curve of the bar 1, which hangs down slightly forward, first turns upward with a light pull on the rein. It is only with a stronger pull on the rein (about 3 to 4 cm.) that the bar 1 exerts pressure on the tongue. Pressure on the tongue is limited secondly, in that the center portion 10 of the bar 1 is made as a soft thickening 38 shaped like a plum pit.

This bit, too, is recommended especially for use in the training of young horses as well as in riding schools since in contrast to the rubber snaffle frequently used otherwise it keeps the mouth softer.

FIGS. 24 to 27 show a further development, as defined in the invention, of the usual water snaffle. The usual water snaffle has frequently an unpleasant effect on the horse because the ring link 39—even with a slight pull on the reins—presses too sharply on the tongue, causes unnecessary friction on the palate and, on horses with a relatively sharp edge of the jaw bone, pinches the edge of the tongue laterally between the bit and the edge of the jaw bone.

The further development as defined in the invention excels by the fact that the eye 40 is integrated smoothly on the tongue side as well as on the palate side into the following zone 41 in such a way that on both sides of the ring joint common otherwise there originates a continuous line which cannot lead to chafing, blisters or soreness—neither on the tongue nor on the palate and therefore no longer lies pointlike on the tongue when there is pull on the reins but as a whole bit lies uniformly on the tongue.

With the common prior art snaffle the horse's tongue is frequently pinched when the reins are pulled. Furthermore, the juncture of the two parts of the standard snaffle has a point that chafes the palate. These deficiencies are overcome by the snaffle illustrated in FIG. 25. However, some horses have a relatively sharp edge of the jaw bone 51 (bone edges of the lower jaw covered with skin tissue) or a wide but relatively thin tongue so that the edges of the tongue are pinched between the jaw bone 51 and the bit sides 7, 8 whereby the different tongue defects originate, such as pulling up the tongue over the bit (the edges of the jaw bone are relatively insensitive to pain), putting out the tongue downward or more frequently toward a certain side. Especially the last two defects of the tongue were not correctable up to now and can be corrected only by the bits according to FIGS. 21–23 as defined in the invention.

Figure 26:
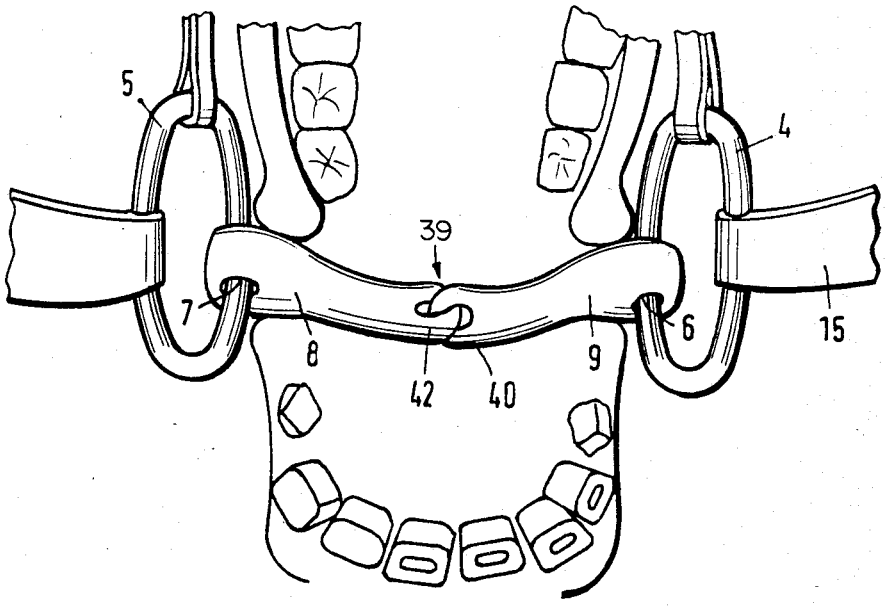
Figure 24:
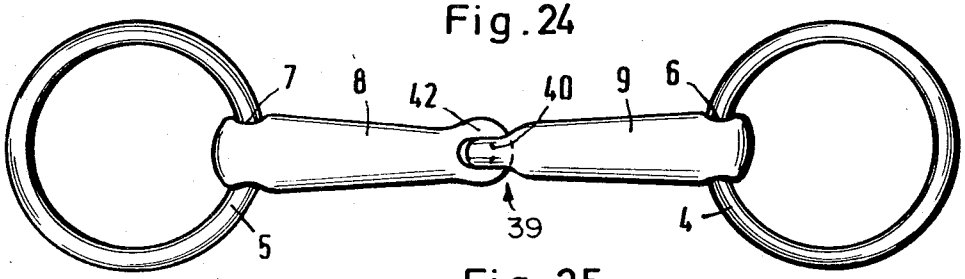
FIG. 24 shows a front view of another type example of the bit as defined in the invention.
Figure 25:
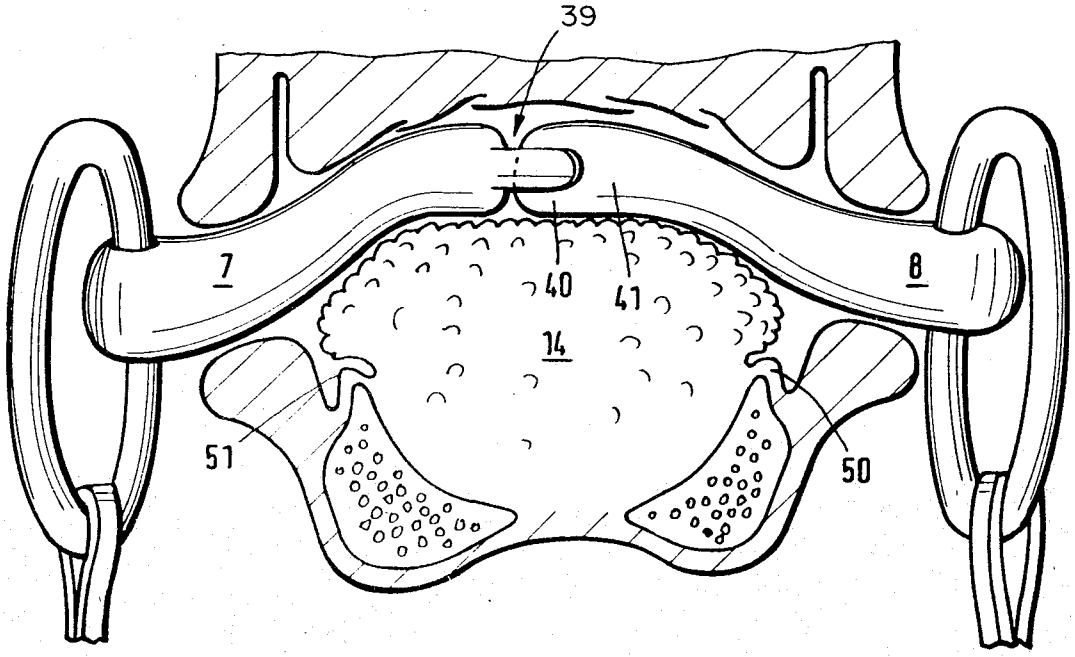
FIG. 25 shows a top view of the inserted bit from FIG. 24.

Furthermore, the two sides 8–9 according to FIGS. 24–26 are formed uniformly strong and bent on both sides. Thereby severe tongue defects, as described in the preceding, can be avoided at least preventively.

Figure 27:
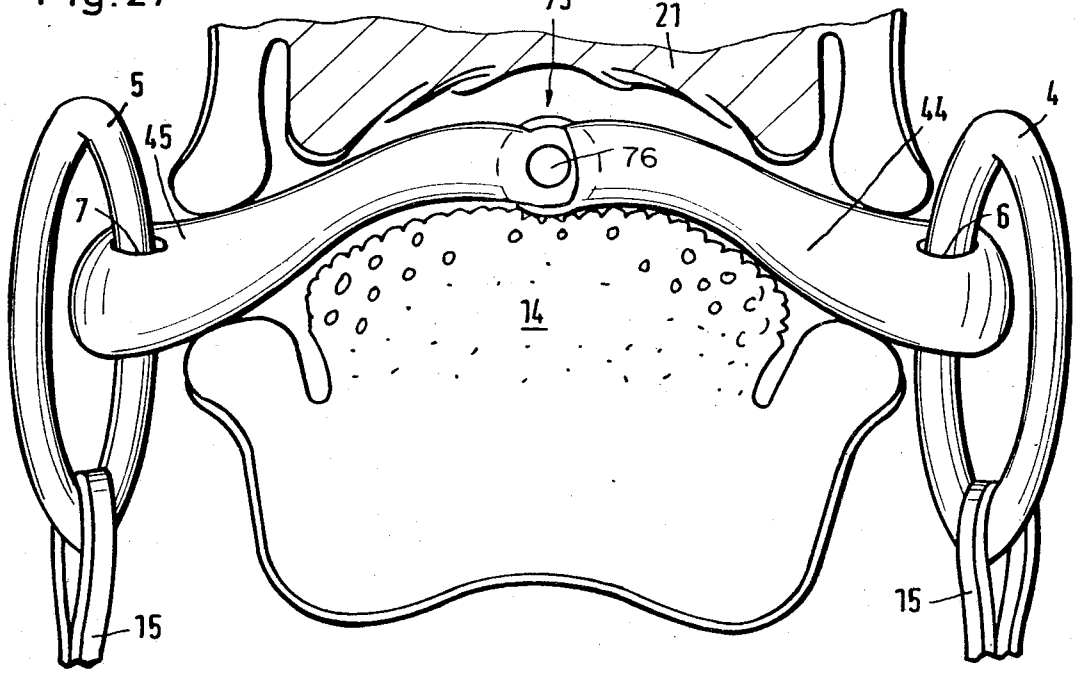
FIG. 27 shows a top view of another type example of the bit as defined in the invention.
Figure 28:
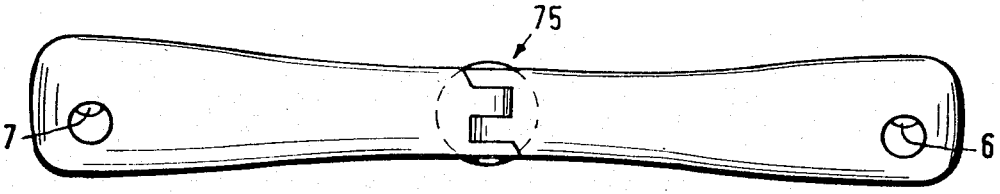
FIG. 28 shows a back view of the bit from FIG. 27.
Figure 31:
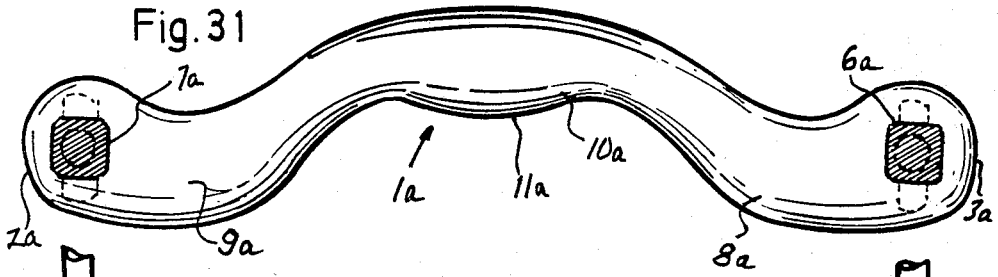
FIG. 31 is a view similar to FIG. 2 showing a modification of the invention.
Figure 32:
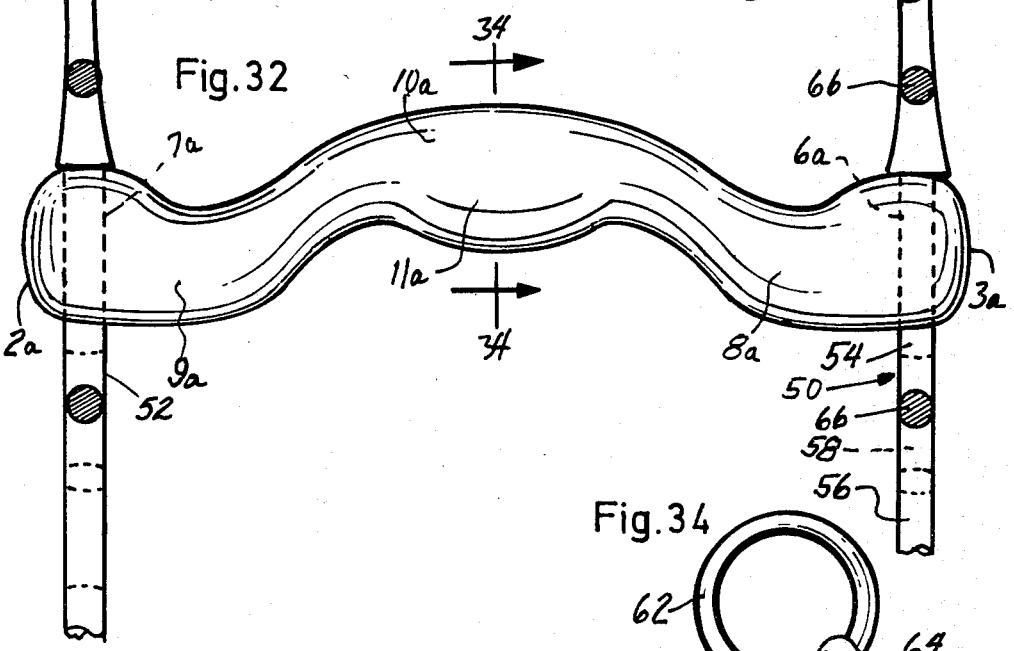
FIG. 32 is a view similar to FIG. 1 showing the modification of FIG. 31.
Figure 34:
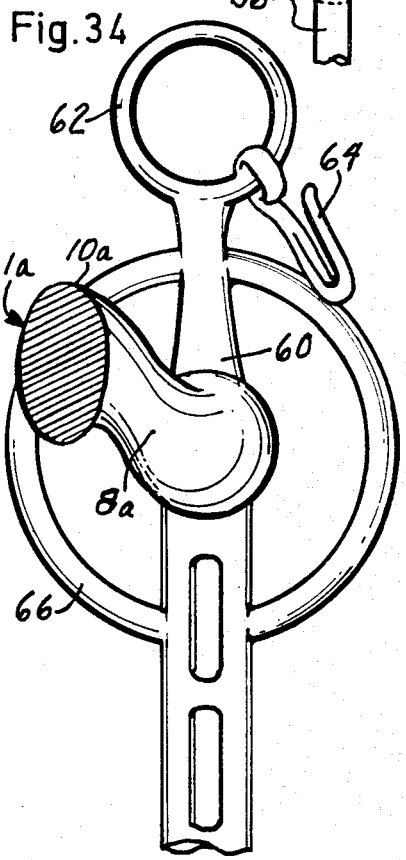
FIG. 34 is a view partly in cross section and taken substantially along the line 34—34 in FIG. 31.
Figure 33:
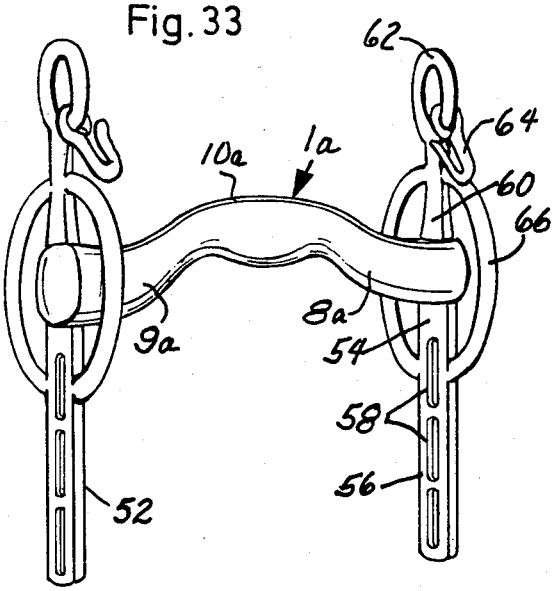
FIG. 33 is a perspective view of the embodiment of the invention shown in FIGS. 31 and 32.

The further embodiment of the invention according to FIGS. 27 to 29 shows a two-part bit where the first side part 44 is connected with a second side part 45 by way of a precise spherical hinge 75. The outer contour of the hinge 75 is made so smooth that trouble on the tongue 14 is out of the question. One sees also especially from FIG. 27 that the first side part 44 as well as the second side part 45 on both sides of the hinge pin 76 are rigidly curved in the direction of the tongue whereby the formation of an acute pinching angle is prevented in case of a strong pull on the reins. Otherwise, this bit especially with respect to the inclination of the axis of the eyelets 6, 7—is made essentially similar to the first embodiment of the invention.

This form of the bit combines the advantage of a rubber bit with a very versatile usability, however, without having the disadvantageous adhesive characteristics of rubber. If the center portion 10 is made thinner, this bit can be used also as a support snaffle for the bridle-bit.

In FIG. 27, the initial position of the bit is illustrated. When the reins are pulled, the angle with the tongue narrows and widens again when the pull on the reins is lessened.

Figure 30:
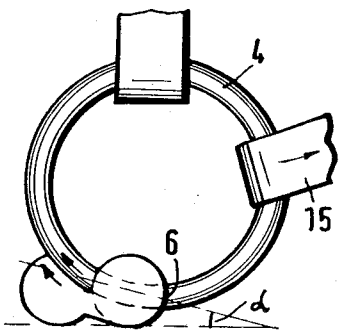
FIG. 30 shows a schematic illustration for the explanation of the mode of operation as well as the position of the eyelets relative to the bit plane for the bits from FIGS. 1–5.

As it can be further recognized especially in FIG. 30, the rigid bridoon bit as defined in the invention excels by the fact that the axis of each eyelet 6, 7 rises—with the bit lying flat—from the back to the front toward the nose by an angle $\alpha$ which is about 20 degrees. If one puts down the bit with the sides reversed, thus in a way that the right side lies toward the left and vice versa, the axis of the eyelet, 6, 7 descends by the same angle $\alpha$ from the back to the front. Therefrom the possibility results to have the bit—after the buckling—act on a higher or lower spot of the tongue.

The embodiment of the invention as shown in FIGS. 31–34 is generally the same as that shown in FIGS. 1–6, and like parts are identified by similar numerals with the addition of the suffix a to avoid prolixity of discussion. The essential distinction in this embodiment is that the eyelets 6 and 7 are not provided with bridoon rings, but on the contrary are provided respectively with curb arms 50 and 52. Curb arms are well known in the art, and may take many different configurations. The particular curb arms illustrated in FIGS. 31–34 are those known as the Liverpool-curb.

The curb arms 50 and 52 are identical, and thus only curb arm 50 is described. The curb arm 50 includes a shank 54 extending through the eyelet 6*a*. It may form a tight fit, or be welded or otherwise secured in place. The longitudinal axis of the shank 54 is parallel (not transverse) to the longer ellipse axis of the center section 10*a*, and to that end the eyelets 6*a* and 7*a* are turned 90 degrees from those in FIGS. 1 and 2. A shank extension 56 rearwardly of the bridoon bit is provided with three elongated openings 58, while in the opposite direction a shank extension 60 is slightly wider than the shank to limit penetration thereof through the eyelet 6*a*, and tapers therefrom. A ring 62 is provided at the extremity of the extension 60 and carries a curb chain hook 64, the construction and use of which are well known in the art. As will be apparent, the axis of the ring 62 is arranged generally longitudinally of the axis of the bridoon bit 1*a*. Finally, the curb arm includes a ring 66 having an axis parallel to that of the ring 62, and fixed to the shank extensions 54 and 60, centered about the adjacent portion of the bridoon bit.

The bridoon is not shown, but will be understood as being connected to the upper and lower ends of the curb arm, while the curb chain also is not shown but will be understood as being secured to the curb chain hook 64.

Figure 35:
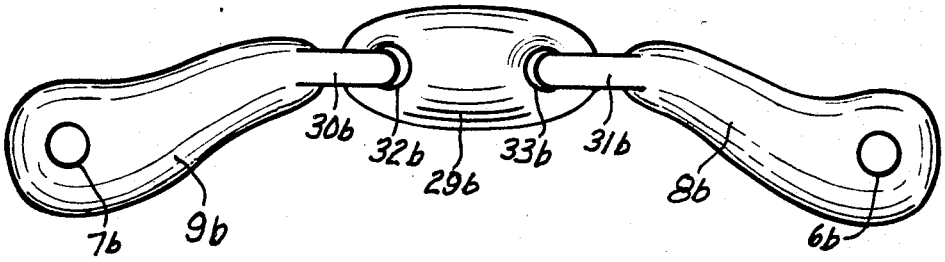
FIG. 35 is a view similar to FIG. 17 showing a further embodiment of the invention.
Figure 36:
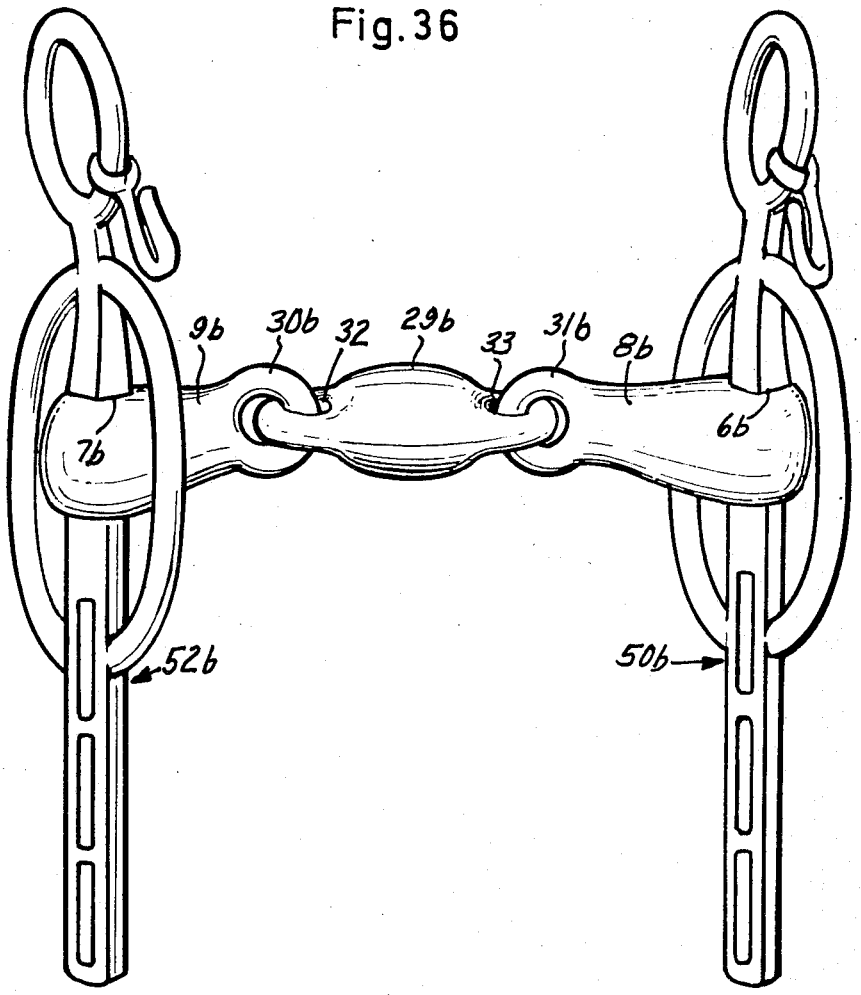
FIG. 36 is a perspective view of the embodiment of the invention shown in FIG. 36.

The embodiment of the invention as shown in FIGS. 35 and 36 is similar to that shown in FIGS. 17–20. Similar parts are identified by like numerals with the addition of the suffix b. The essential distinction is that rather than the provision of rings through the eyelets 6*b* and 7*b*, there are curb arms 50*b* and 52*b* identical with those just described in connection with FIGS. 33 and 34.

On the embodiments of the invention explained in the preceding, many kinds of modifications are familiar to the expert without departing thereby from the idea of the invention. Although the attached drawings are to be regarded as independent means of disclosure in the sense that characteristics of the invention can be learned possibly also from the drawn representation, the invention, on the other hand, is not restricted to the details of the embodiments.

The invention is claimed as follows:

1. A bridoon bit comprising a bar including a center segment and two lateral end portions, each of the lateral end portions having an eyelet through each of which there extends a curb arm connecting with the bridoon, the improvement comprising a thickened center segment (11) with a curved lateral axis and having soft transitions (10, 12) to the end portions (8, 9) on either side of the center segment, said portions being curved in a direction reverse to the curvature of the center segment, the cross-section (22) of the thickened center section being substantially elliptical, the longer longitudinal axes thereof (FIGS. 4, 32) being parallel to the axis of the eyelets (6, 7) on both sides.

2. A bridoon bit comprising a divided bar including a center segment and two lateral end portions, each of the lateral end portions having an eyelet through each of which there extends a curb arm connecting with the bridoon, the improvement comprising a thickened center segment (11) with a curved lateral axis and having soft transitions (10, 12) to the end portions (8, 9) on either side of the center segment, said portions (8, 9) being curved in a direction reverse to the curvature of the center segment, the center segment (29) being a separate part coupled with the two side portions (8, 9) each by annular eyes (30, 31), the cross-section (22) of the thickened center section being substantially elliptical, the longer axis thereof (FIGS. 4, 32) being transverse to the longitudinal axes of the eyelets (6, 7) on both sides.

* * * * *